United States Patent [19]

Cano

[11] Patent Number: 4,580,296

[45] Date of Patent: Apr. 8, 1986

[54] COMBAT SPORTS EQUIPMENT

[76] Inventor: Richard A. Cano, 1118 Cypress, Pueblo, Colo. 81004

[21] Appl. No.: 540,278

[22] Filed: Oct. 11, 1983

[51] Int. Cl.[4] ..... A41D 13/00; A41D 13/08

[52] U.S. Cl. ..... 2/2; 2/18

[58] Field of Search ..... 2/2, 18

[56] References Cited

U.S. PATENT DOCUMENTS

| | | | |
|---|---|---|---|
| 421,447 | 2/1890 | Stewart | 2/18 |
| 1,040,267 | 10/1912 | Brewster | 2/2 |
| 1,105,569 | 7/1914 | Lacrotte | 2/2 |
| 1,269,930 | 6/1918 | Hawley | 2/2 X |
| 1,276,200 | 8/1918 | Flanagan | 2/2 X |
| 1,303,510 | 5/1919 | Sokol | 2/2 |
| 3,185,476 | 5/1965 | Fechner | 2/18 X |
| 3,855,633 | 12/1974 | Rhee | 2/18 |
| 4,095,294 | 6/1978 | Winterbottom | 2/18 |

*Primary Examiner*—Louis K. Rimrodt

[57] ABSTRACT

A suit for use in combat type sports easily secured and removable for wearing by a user's body to protect same from damage by blows which may be struck by parts of another suit. The suit includes apparatus which completely encloses a user's body and has a generally non-flexible and preferably lightweight outer armor which is padded on the inside to absorb shock during use. A helmet is securely attached to an upper body armor so that the shock of a blow to the head area of a user will transfer to the bottom of the upper body armor and thereby eliminate any damage to the head. Lower arm components enclose the lower arms of a user and include portions which are gripped by the user's hands, and hence, the ends of these components which extend past the hands will generally make contact in punching another suited opponent during use. Separate components enclose and are adapted to provide maneuverability of a user's arms, legs, feet and waist or torso. Blows may also be struck with the helmet and components enclosing and protecting a user's shoulders, elbows, forearms, knees and feet. Armored shoes protect a user's feet and may have spiked soles to prevent a user from slipping. A portable boxing ring like arena may be selectively positioned in height to allow users to be forced over it and it may be utilized inside of or without a boxing ring.

14 Claims, 3 Drawing Figures

COMBAT SPORTS EQUIPMENT

BACKGROUND OF THE INVENTION

The present invention relates generally to combat type sports similar to Boxing and the like and more particularly to improvements in apparatus utilized in such sports.

In contests of these sports, it is an object of the participants in order to win as well as a preference of the viewers for reasons of excitement that knockdowns be scored. However, often it is an object and a necessity to hurt a participant even severely in order to knock the participant down, which can be hazardous to a participants health and even life threatening or fatal, because when a punch or blow connects with the chin of a boxer for example, the inertia of the blow will create a shock which may jolt the head of the boxer in a certain direction and although said shock is often absorbed in the muscles of the boxer from his or her neck down without even knocking the boxer down, it has too often and may continue to cause concusions and the like and burst blood vessels in the brains of boxers causing inevitable death.

Throughout the history of sports like boxing, devices have been made and utilized to increase the safety of participants in these sports, such as head gear, mouth pieces, padded gloves, tape for hands, safety cups, shin guards and foot pads, to help prevent damages and cuts and to absorb and decrease the shock of blows from punches and kicks, etc., however, there have been nearly 370 deaths resulting from Boxing and numerous serious injuries relating to brain damage, blindness, etc., as well as less severe injuries such as cuts, broken noses, jaws, ribs, and metacarpals. Recently, organizations and individuals have even endorsed pursuits to ban Boxing entirely. There also has been extensive controversy concerning the systems utilized for scoring points and the stopping of fights due to alleged damages to participants in these sports contests.

Primary objects of the present invention are; to provide additional sports, improve upon the safety of the participants in conventional combat type sports which is provided by the apparatus utilized in these sports, and to eliminate the controversies in such sports by providing apparatus to simplify the scoring systems by reducing or eliminating the chance of damages occuring to participants and stopping of the contests by reasons therefor, and also to increase the excitement of such sports by increasing the number of knockdowns in each contest due to the transference of shock caused by blows, through an upper body armor and helmet or the like, to a participants waist and legs, and overcoming the participants balance, whereby the scoring systems may be simplified on a point per knockdown basis or the like and although participants may be unable to rise and commence combat within ten seconds or so due to fatigue, they will not get hurt and the contests will not be stopped therefor, thereby eliminating extensive controversies relating thereto.

SUMMARY OF THE INVENTION

The present invention consists of apparatus to provide the utmost safety of users of this invention for combat type sports contests while simultaneously decreasing the ability of the users to absorb the force or shock of an opponents punches, kicks, etc., while remaining in an upright or standing position, and thus to substantially increase the number of knockdowns scored in these contests, as compared to Boxing or the like, without the users getting hurt.

Basically, the invention may comprise an armored suit apparatus which may be worn on and entirely enclose a users body. The suit may preferably be lightweight and durable and made of plastic or rubber or most any materials. Further, the suit may include a virtually single component of armor which may simultaneously enclose a users head and upper body excluding the shoulders and arms, so as the inertial impact of a blow struck to the area of a users head, will be transmitted to the bottom of said component near the waistline of the user, thereby minimizing damages to the head area of a user including chances of concussions, bursted blood vessels in the brain, death, etc., and also maximizing the effects of the forces of shock due to the transmitted inertia following the impact of such a blow onto the waistline area and legs of a user, whereby the substantial elimination of the ability of a user to absorb the shock of a blow to the head, with muscles medial the head and waist, will result in substantially more knockdowns and thus excitement in these types of sports as well as simplified and non-controversial scoring systems.

Various other components may separately enclose and protect all or any other parts of a users body including components for punching which comprise handles designed to be gripped by users hands. Padding may be included throughout the inside of the various components of the suit to help absorb the shock of the blows and prevent abraisions, bruises, cuts, etc. Various components of the suit may be omited.

Users may perform the combat contests most anywhere, however, various ring type arenas may be utilized to alter the sports and a variation of the conventional Boxing type ring may also be utilized to provide additional excitement whereby a rope or the like may be positioned waist high for example so as a participant may be backed against and virtually knocked over the same instead of merely being cornered in a conventional Boxing ring whereby the participant would be virtually unaffected by an opponents blows due to the extensive protection provided by the present invention.

BRIEF DESCRIPTION OF THE DRAWINGS

The invention will be described with reference to the accompanying drawings, wherein.

DESCRIPTION OF A PREFERRED EMBODYMENT

Figure 1:
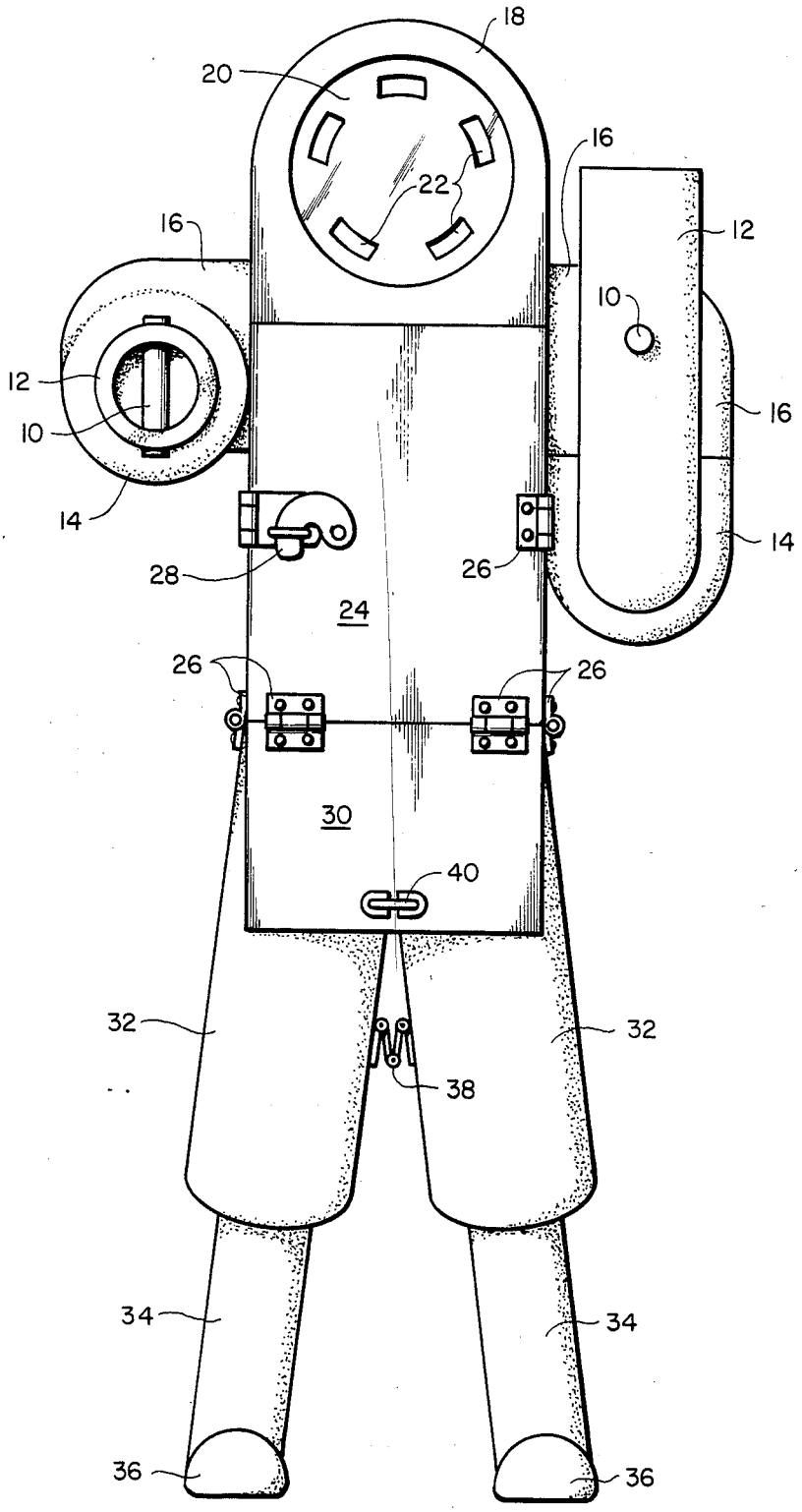
FIG. 1 is a side view of an apparatus which completely encloses the body of a user of various embodyments of equipment utilized with the present invention.

A combat sports suit constructed in accordance with various embodyments of the present invention is shown in FIG. 1. Here a pair of padded handles 10 are provided for gripping by a users hands and are secured inside of punching parts 12 which enclose a users lower arms and are adapted to pivot in connection with elbow protectors 14 which subsequently rotate in connection with shoulder protectors 16 which are also adapted to rotate in connection with an upper body armor including a front shield 24, and back and side shields (not shown). Hinges 26 and hasps 28 may be utilized in securing or removing the upper majority of the suit to or from a user, respectively. A helmet 18 may be permanently combined with or securely attachable to the upper body armor so as to not rotate or displace thereon. A transparent face shield 20 has appertures 22 for vision and ventilation. Hinges 26 may also secure front and back lower body shields 30 (back lower body shield not shown) and upper leg protectors 32 to the side shields. A four-sided hinge 38 may secure the upper leg protectors 32 together and an extension spring 40 may connect the front and back lower body shields 30, respectively, to prevent a punch or kick from entering the groin area beneath the lower body shields 30. Lower leg protectors 34 may underlap the upper leg protectors 32 and foot protectors 36 may include spikes or the like (not shown) under the soles thereof to prevent a user from slipping. Padding (not shown) may be combined on the inside of all components mentioned above to increase the comfort of wearing the same and to prevent various types of injuries.

Figure 2:
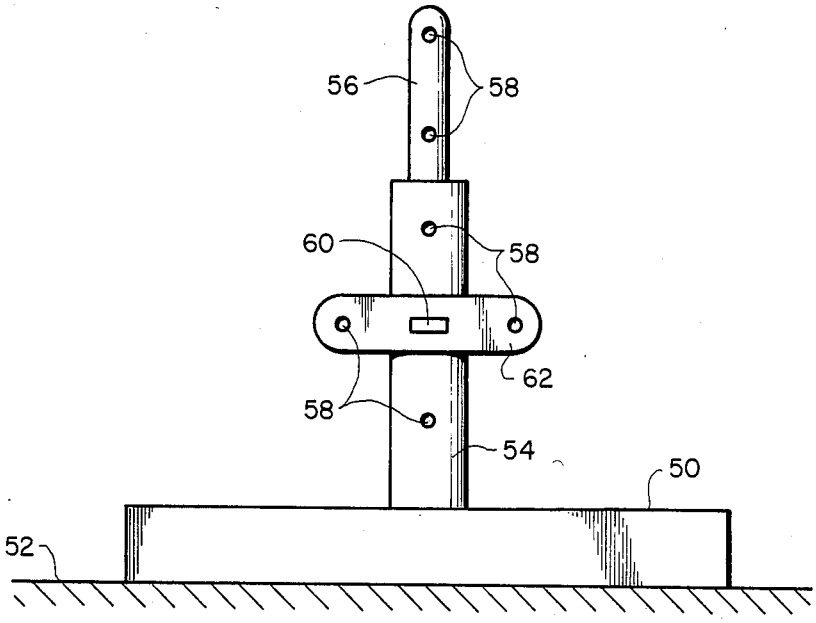
FIG. 2 is a side view of an apparatus which may combine with more of the same by ropes or the like to create a Boxing ring like arena for users of various embodyments of equipment utilized with the present invention.

A component for use with the present invention is shown in FIG. 2. Here a Boxing ring like apparatus adapted for use either inside of and connected to a conventional boxing ring or the like, or in a wide open space, may comprise a platform 50 which rests on a floor 52, a post 54 projects upwardly from the platform 50, the post 54 may be hollow so as a rod 56 may be inserted therein. Appertures 58 may be spaced generally along the spot 54 and the rod 56 so as a pin 60 may be inserted therein in order to adjust the height of the top end of the rod 56 whereby tension lines (not shown) such as ropes or metal rods or the like may be secured at the topmost apperture 58 and any other apertures 58 that may be appropriate, including appertures 58 within collars 62 of which more than one collar 62 may be utilized on each post 54 or rod 56, in order to provide the boundaries of the apparatus as equivalent to the ropes in a conventional boxing ring. Additional tension lines or the like may also secure the posts 54, rods 56 and or collars 62 to a supporting means such as conventional boxing ring posts or to stakes driven in the ground, etc. It will be appreciated that the height of this boxing ring like apparatus may be positioned at a lower level than the top rope of a conventional boxing ring so a user of the present invention may be preferrably knocked over and out of the same, depending on the selected rules of each contest which may vary in ways too numerous to mention at this point and provide alternative sports.

Figure 3:
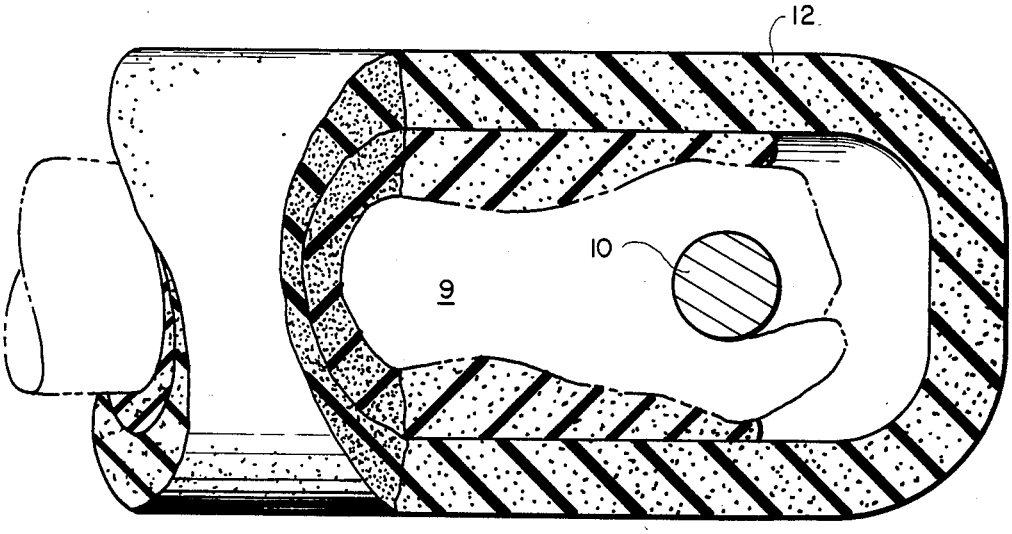
FIG. 3 is a sectional view of an apparatus mainly for punching with which enclosed an arm of a user of various embodyments of equipment utilized with the present invention.

Any type of punching apparatus which may be used with or without the present invention is shown in FIG. 3. It may be the same as the punching part 12 shown in FIG. 1. Referring to FIG. 3, the fron end of the punching part 12 which generally makes contact when a punch connects correctly, is closed and generally smooth (without sharp edges or corners). Padding or the like including a brace apparatus for the wrist (not shown), may be used inside and outside of the punching part 12, respectively, to brace and protect a users knuckles, metacarpals, wrist, and arm 9 securely, and to reduce damages inflicted upon an opponent, respectively.

Although particular embodiments of the present invention have been described and illustrated herein, it should be recognized that modifications and variations may readily occur to those skilled in the art and that such modifications and variations may be made without departing from the spirit and scope of this invention. Consequently, this invention as claimed below may be practiced otherwise than as specifically described above.

I claim:

1. A body protector for use in contact, combative recreational sports and adapted to be worn by a sport participant and to receive blows from the limbs and body of an opposing sport participant comprising:

a front torso shield fashioned of substantially inflexible material adapted to be worn over the chest and stomach of the sport participant;

a helmet fashioned of substantially inflexible material adapted to be worn about the head of the sport participant, said helmet connected to and being nondisplaceable relative to said front torso shield when so connected;

means for mounting said front torso shield and said helmet onto the sport participant.

2. A body protector according to claim 1 wherein at least a portion of said helmet is transparent and said helmet includes at least one aperture for ventilation.

3. A body protector for use in contact, combative recreational sports and adapted to be worn by a sport participant and to receive blows from the limbs and body of an opposing sport participant comprising:

a substantially box shaped torso shield fashioned of substantially inflexible material adopted to surround the torso of the sports participant;

a helmet fashioned of substantially inflexible material adapted to be worn about the head of the sport participant, said helmet connected to and being nondisplaceable relative to said torso shield when so connected; and means for mounting said torso shield and said helmet onto the sport participant.

4. A body protector according to claim 3 further comprising means for removable connecting said helmet to said torso shield.

5. A body protector according to claim 3 wherein at least a portion of said torso shield comprises a movable door adapted to facilitate the wearing and removal of said torso shield by the sport participant.

6. A body protector according to claim 5 further comprising at least one hinge, wherein said door is pivotably connected by means of said hinge to the other portion of said torso shield, and further comprising means for selectively inhibiting said door from pivoting about said hinge.

7. A body protector according to claim 3 further comprising a groin shield fashioned of substantially inflexible material adapted to be worn over the groin area of the sport participant and displaceably connected to the lower front portion of said torso shield.

8. A body protector according to claim 7 further comprising a pair of leg shields each fashioned of substantially inflexible material adapted to cover at least the front surface of at least a portion of the sport participant's leg and each displaceably connected to the lower portion of said torso shield.

9. A body protector according to claim 8 further comprising a pair of upper arm protectors each fashioned of substantially inflexible material adapted to cover at least a portion of the sport participant's upper arm and each connected to the upper portion of said torso shield.

10. A body protector according to claim 9 further comprising a pair of gloves each adapted to cover the sport participant's hand and forearm and adapted to forcefully contact the opposing sport participant, each glove fashioned and shaped such that when said glove is worn by the sport participant the knuckles of the hand of the sport participant are substantially out of contact with the interior surface of said glove even when said glove is in forceful contact with the opposing sport participant.

11. A body protector according to claim 3 wherein at least a portion of said helmet is transparent and said helmet includes at least one aperture for ventilation.

12. A body protector according to claim 3 further comprising at least one glove adapted to cover the sport participant's hand and forearm and adapted to forcefully contact the opposing sport participant, said glove fashioned and shaped such that when said glove is worn by the sport participant, the knuckles of the hand of the sport participant are substantially out of contact with the interior surface of said glove even when said glove is in forceful contact with the opposing sport participant.

13. A body protector according to claim 12 wherein said glove includes a handle extending across the interior of said glove adapted to be grasped by the sport participant's hand and further includes means for substantially preventing the rotation of such hand about an axis substantially coextensive with the forearm of the sport participant.

14. A body protector according to claim 13 wherein at least a substantial portion of said glove is fashioned of substantially inflexible material.

* * * * *